United States Patent [19]

Lorca

[11] 4,154,365

[45] May 15, 1979

[54] DISPENSING CONTAINER

[76] Inventor: Antonio Lorca, Rio Tiber 103-3rd Floor, Mexico, 5, D.F., Mexico

[21] Appl. No.: 826,919

[22] Filed: Aug. 16, 1977

[30] Foreign Application Priority Data

Sep. 30, 1976 [MX] Mexico ..... 166510

[51] Int. Cl.[2] ..... G07F 11/00

[52] U.S. Cl. ..... 221/4; 221/122; 221/154; 221/302; 221/306; 206/536

[58] Field of Search ..... 221/65, 69, 83, 91–94, 221/97, 98, 101, 106, 120–123, 135, 151, 154, 268, 269, 276, 302, 303, 306, 190, 186, 289, 2, 4, 5; 222/548, 549, 559, 153, 541, 523; 133/5 R, 5 A, 5 B, 6; 206/535–537, 533

[56] References Cited

U.S. PATENT DOCUMENTS

| | | | |
|---|---|---|---|
| 781,527 | 1/1905 | Jeffers | 206/536 |
| 1,824,862 | 9/1931 | Young | 221/302 |
| 3,095,085 | 1/1963 | Meijer | 221/122 |
| 3,159,308 | 12/1964 | Passavanti | 221/289 |
| 3,166,216 | 1/1965 | Guarr | 221/289 |
| 3,269,597 | 8/1966 | Passavanti | 221/186 |
| 3,430,824 | 3/1969 | Conners et al. | 222/523 |
| 3,610,466 | 10/1971 | Raybois | 221/135 |

FOREIGN PATENT DOCUMENTS

| | | | |
|---|---|---|---|
| 1092506 | 4/1955 | France | 221/306 |

*Primary Examiner*—Robert J. Spar
*Assistant Examiner*—H. Grant Skaggs
*Attorney, Agent, or Firm*—Lowe, King, Price & Becker

[57] ABSTRACT

This invention refers to a novel container for articles to be dispensed one at a time and comprises two receptacles, one within the other, each having an opening in its respective wall, and the openings when aligned, allow the articles contained within the inner receptacle to be emitted one at a time. Particularly, the invention relates to a novel container especially for dispensing small articles such as pills, lozenges, tablets, capsules, troches, pearls and the like.

16 Claims, 22 Drawing Figures

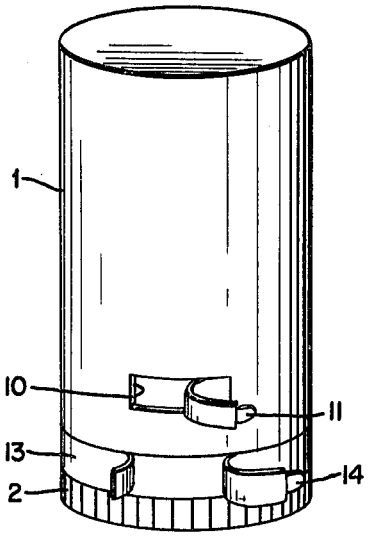
Fig. 17
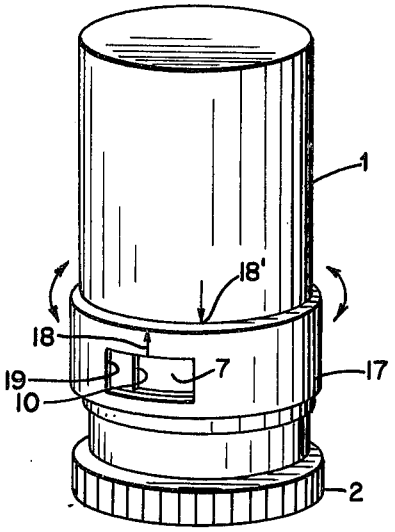
Fig. 18
Fig. 19
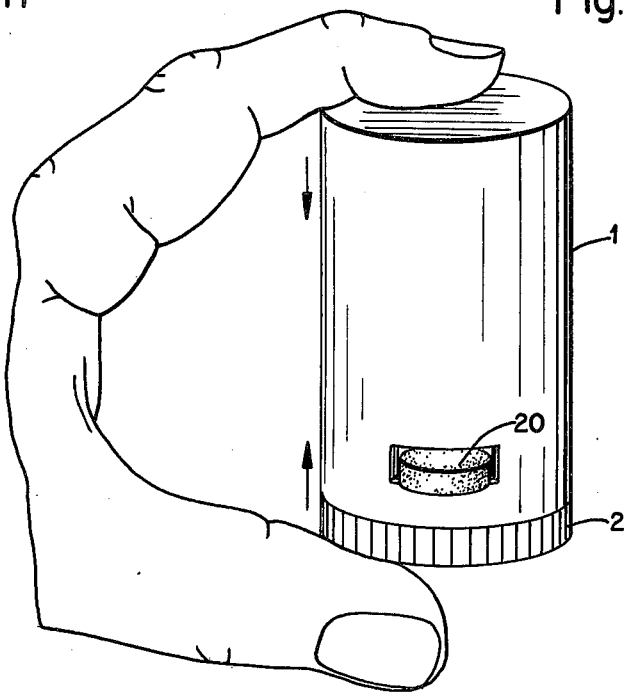
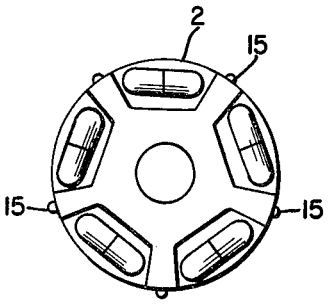
Fig. 20
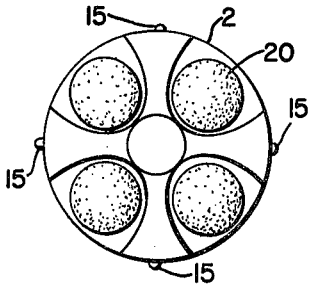
Fig. 21
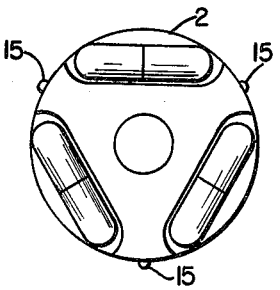
Fig. 22

DISPENSING CONTAINER

BACKGROUND OF THE INVENTION

Presently there is a need throughout the world for a simple, practical and versatile container for medicaments of various kinds in order to substitute the old containers which have been used for many years for packaging medicaments presented in solid form, such as pills, lozenges, tablets, capsules, troches, pearls and the like, which, in order to be taken out of their container, represents many cumbersome manipulations for the persons who need the same. Moreover, said medicaments may be susceptible to contamination since in most cases, they are handled directly by hand. As is well known, when a person has to take pills, lozenges, tablets, capsules, troches, pearls and the like, he must perform the following:

First. It is necessary to open the container wherein the medicament is contained, this container usually having a threaded cap attached to a hermetically closed seal that is necessary to fracture or break.

Second. In order to break the hermetically closed seal, the person has to make an extraordinary effort for unthreading the cap and destroying said seal, and frequently the seal is not separated uniformly and is broken partially. Consequently, it is necessary to use a cutting instrument or exert a major effort to accomplish total separation of the cap. It is important to notice that these caps are usually manufactured of metallic material, generally aluminum, and thus have sharp edges which, in many cases produce cuts, and in other cases the thread is lost and the cap is separated from the container and it is no longer possible to screw the cap on again to close the container tightly.

Third. Once the separation of the cap is effected, it is necessary to remove the small cotton swab or polyurethane foam pad, which is used in these containers in order to prevent the pills, lozenges, tablets, capsules, troches, pearls and the like from moving freely within the container which usually causes one article to impact against another or against the wall of the container and in many cases, are broken.

Fourth. Thereafter, the person faces a situation in which he has to take out the small cotton swab with one hand and the container with the other one, and the container must be turned upside down on the palm of the hand in order to handle the pills, lozenges, tablets, capsules, troches, pearls and the like. Frequently, the pills fall out in a quantity in excess of one or two and it is necessary to return the extra pills back to the container.

Fifth. Once the person has been able to get a single pill in this hand, he picks up the same with the fingers of the other hand and places it directly to his mouth and the pill is swallowed with a sip of water.

Sixth. Afterwards the person picks up the small swab in order to return the same to the container and proceeds to screw the cap on to its place.

During all the above mentioned steps the container has remained open and the pills are subject to atmospheric contamination and the absorption of atmospheric humidity, which in the long run may lead to degradation of the medicament.

In the past, a great number of attempts have been made to provide a simple, practical and versatile container which overcomes all the above mentioned inconveniences. When plastic materials appeared, glass containers were substituted by plastic containers achieving by these means a reduction in the weight of the containers and also avoiding the problem of the breakage of glass containers. However, the novelty, if it is possible to call same as such, was exclusively in a change in material, keeping the design of the plastic containers identical to the old glass containers.

Recently, many attempts have been made in order to find new designs of containers and avoid some of the inconveniences previously mentioned.

In highly industrialized countries, especially in the United States of America, new containers have been developed which have caps or closure devices that are more trouble-free to operate and which perform more efficiently. Particular attention has been given to the containers called "child-proof containers" which are intended to prevent children from opening containers filled with dangerous medicaments. However, in most cases, instead of furnishing a more simple opening and closure of the containers, the desired result has been reached by complicating the performance of the caps for said containers.

In the pharmaceutical and drug market there is another type of package for small solid articles and this consists of the packages known as "Blisters" which comprise two sheets, generally one being of a thermoplastic material and the other of a metallic material, usually aluminum foil. The small articles are trapped between the two sheets and within an ampoule made in the plastic material sheet and in order to take out such articles, it is necessary to break the metallic material and thus it is possible to take the small article directly by the fingers of the hand so as to place same in the mouth.

This type of container has as a main disadvantage the fact that much material must necessarily be used in comparison with the small number of articles which may be packaged; consequently, the cost is very high. Furthermore, special equipment is required for packaging and such equipment is also costly. Finally, the packaging materials, in view of their special characteristics and specifications, since in some cases they constitute a true sandwich of different sheets or foils, are different and costly to elaborate. Besides the above, these containers still retain some of the disadvantages as above mentioned in connection with the old type of containers.

Another type of container which has been widely used in the market consists of a sandwich of two sheets of cellophane or aluminum between which the pills are located at uniform distances. Some of these types of packages have weakened lines which allow cutting a square of material containing the pill. All the above seem to be simple. However, the problem arises when a person desires to remove a pill from the square or small pocket containing same. Since in this square the material is uniform and there are not weakened lines, it is necessary to use a cutting instrument and in most cases, a person uses his nearest cutting instrument available, i.e. his teeth. As it may be easily understood the result is highly anti-hygienic.

In the United States patent art, various devices are known which comprise depressible elements in order to align openings in outer and inner containers for dispensing articles such as pills. Devices of this type are known for example in U.S. Pat. Nos. 2,772,772, 2,960,259, 3,612,348 and 3,762,539. With respect to the present invention, the pertinent art of which Applicant is aware is U.S. Pat. No. 3,762,539 to Kerr which discloses a pill dispenser constructed of two plastic tubes equipped with a spring-biased twist and lock mechanism. However, the present invention represents an improvement over devices such as that of Kerr as the device of the present invention is more practical since there is no need of twisting action as it would be necessary with Kerr's dispenser which, in order to be operated, needs two hands and two depressing steps. This is in contrast to the device of this invention, which is operated by a single depressing step with two fingers of one hand. Further, the inventive container can be assembled more easily than Kerr's because there is no protrusion which should be fitted precisely in a pathway. Moreover, since the opening in Kerr's dispenser is in its upper section, the dispenser must be tilted almost all the way around in order to let the tablets exit. It is also more difficult to deposit the tablet directly in the mouth. In the claimed container, the pills are always ready to exit and may fall directly in the mouth. In addition, in Kerr's dispenser, the safety integral detachable sections of the proposed dispenser are not shown or taught and Kerr's dispenser does not show child-proof means.

Contrary to all the above, the present invention avoids once and for all the inconveniences of the known containers which are presently available in the market.

SUMMARY OF THE INVENTION

It is a primary object of the invention to provide a simple, practical and versatile containers for supplying articles one at a time.

Another object of the invention is to provide a container particularly suitable for supplying medicaments in solid form, such as pills, lozenges, tablets, capsules, troches, pearls and the like.

Another object of the present invention is to provide a child-proof, simple, practical and versatile container, which due to its novel characteristics, prevents children from 1 to 2 years from taking small articles contained in this novel container.

It is still another object of the present invention to provide a container which, due to its novel characteristics, allows packaging small articles of various shapes and sizes.

It is yet another important object of the present invention to provide a novel container which is highly practical, easy to make, and reliable in its performance.

GENERAL DESCRIPTION OF THE INVENTION

For the sake of simplification, the small articles mentioned, such as pills, lozenges, tablets, capsules, troches pearls and the like, will be identified hereafter only as small articles.

The design of this novel container is so simple that the same comprises only three main parts which are the following:

(1) A first receptacle, preferably closed in one end, although it may have both ends closed, and which may be subdivided, containing the small articles to be supplied and provided with a small opening in its wall, which is slightly larger than the articles and follows their shape or better said, the cross-section thereof.

(2) A second receptacle, larger than and telescoped over the first one, having one end closed and also having an opening in its wall slightly larger than the small articles, this opening following the cross-section of the articles.

(3) A resilient element located between the two said receptacles, outside the first or inner receptacle, in such a way that this resilient element exerts a force which tends to separate both receptacles.

In order to avoid the situation where the inner receptacle may be pushed away from the outer receptacle due to the separating force exerted by the resilient element, the outer receptacle has on the edge of its opening a small rib which abuts a corresponding small ring in the inner receptacle. It is important to notice that the receptacle preferably has a cylindrical shape and that it is possible that the inner receptacle may be subdivided. Likewise, it is also possible that the external shape and, therefore, the cross-section of the receptacles, may differ from a cylindrical shape. For example, a square, triangular, rectangular, pentagonal, hexagonal shape, etc., may be used.

OPERATION OF THE INVENTION

In order to operate the container, it is only necessary to press the outer receptacle against the inner receptacle, overcoming the resistance of the resilient element until the two openings are in registry. At this moment the exit of one of the small articles is allowed and it is possible to deposit the same directly into the mouth. It is also important to notice that the small articles are placed within the inner receptacle in a stacked form, one above the other, and therefore, it is impossible that more than one article be dispensed from the container at any time. Movement of the outer receptacle over the inner receptacle is limited by the inner receptacle which has a base with a peripheral shoulder.

The novel container of this invention is highly practical since it maintains the external appearance of the containers to which people are accustomed and also because it may be filled by means of the conventional machinery and equipment used to fill the medicament containers of the prior art.

Also, mention should be made that the novel container can be made of any suitable thermoplastic material, preferable polyethylene, polystyrene, polyvinyl chloride, acrylics, polytetrafluoroethylene, etc.

Another feature that shows the versability of the container of this invention is the fact that the container is easily adapted to many different uses and specifications, depending on the class of small articles to be supplied.

As previously mentioned the container may be easily adapted as a "child-proof" container. In this connection, the container may have two elements and additionally a third element which inhibit the operation of the container, so as to prevent children from one to twelve years from removing the small articles.

The two elements above mentioned, which, my the way, not only contribute to the security but also to the hermeticity of the container, constitute an integral part of the outer receptacle and consist mainly of two detachable sections, one covering the wall opening of the outer receptacle and the other one located in the lower portion of said outer receptacle. By this means, it is impossible to remove from the container the small articles unless both sections are previously detached. As it will be easily understood the second detachable ring in the lower portion of the outer receptacle prevents pressing the same because the ring abouts a lower flange in the inner receptacle, that is, it is not possible to press the receptacles unless this ring has been detached. As already mentioned, this ring may form an integral part of the outer receptacle and may be made of the same material presenting a weakened peripheric line in the wall of the receptacle, having a small flap which facilitates detaching the ring around the lower portion of said outer receptacle.

Obviously, this element constitutes by itself a safety seal for the container.

As it may be easily understood, said two elements provide additional advantages to the invention such as guarantees against tampering, make it humidity-proof and also makes the container a "child-proof container".

Additionally, a third security element may be provided which is also a "child-proof element", this being constituted by a ring loosely held between two small peripheral ribs on the outer receptacle. This ring may be turned around the receptacle in any direction and in order to allow the dispensing of the small articles within the container, it is only necessary to place in register the opening of this ring with the two openings of the receptacles.

Obviously, it must be understood that when this ring is employed the same would be positioned in the drug factory out of registry with the opening of the outer receptacle, thus requiring that the person using the container must turn this ring to obtain registry and then press the container in order to allow the dispensing of the small articles. Finally, it is also possible that the opening of the above mentioned ring may be closed by a detachable integral section of the ring which, of course, provides for greater humidity-proofness and that the opening of the container be more detained.

Furthermore, there should be taken into account that the three above mentioned security elements may be combined in a multiplicity of alternatives and that the use of these elements depends on the particular requirements which need to be satisfied according to the type of small articles to be dispensed.

On the other hand, combining the properties of the materials or better said the plastic materials, for example, by using low density resins and the security elements already mentioned, it is possible to attain greater tightness.

The novel container of this invention is highly functional, since due to its simple design, the containers function easily and the risk of a malfunction is totally avoided. The fact that the container has only three main components insures a constant effective operation. In addition, there are contemplated three different embodiments of the invention, each one being suitable for a particular type of small article or uses.

BRIEF DESCRIPTION OF THE DRAWINGS

In order to illustrate the invention more clearly, a set of drawings is attached herewith:

FIG. 1 is a front view in perspective of two of the three components of the invention which are the inner receptacle and the resilient element;

FIG. 2 is a longitudinal section of the inner receptacle shown in FIG. 1;

FIG. 3 is a front view of the second component of the invention, i.e., the outer receptacle;

FIG. 4 is a longitudinal section of the outer receptacle shown in FIG. 3;

FIG. 5 is a frontal view in perspective of the novel container of the present invention as assembled, and also the sections and tabs which should be detached before use and which constitute certain of the safety elements; and FIG. 6 is a front view in perspective showing the container pressed by the fingers of the user, when a pill is is just about to leave said container.

FIGS. 7 to 11 are related to the second embodiment of the invention, wherein:

FIG. 7 is a front view of the novel container of the invention in its second embodiment, which is called herein a "lipstick-type container";

FIG. 8 is a longitudinal section of the outer receptacle;

FIG. 9 is a front view of the inner receptacle, showing also the resilient element which constitutes an integral part of said inner receptacle;

FIG. 10 is a front view in perspective of the novel container in its second embodiment showing the sections and tabs which should be detached before use and which constitute the basic safety elements of the container; and FIG. 11 is a front view of the container shown in transparent plastic material and wherein 10 mills may be seen located within this receptacle.

FIGS. 12 to 22 are related to the third embodiment of the invention, wherein:

FIG. 12 is a front view of the container as it appears ready for use;

FIG. 13 is a front view of the inner receptacle according to the third embodiment of the invention, showing also the resilient element;

FIG. 14 is a front view in perspective of the outer receptacle in transparent plastic material;

FIG. 15 is a front view in perspective of the outer receptacle in transparent plastic material;

FIG. 16 is an enlarged view of how both receptacles may be blocked, applicable to all the embodiments of the invention shown in FIGS. 1 to 15;

FIG. 17 is a view in perspective of the third embodiment of the container of the present invention showing the detachable safety elements thereof;

FIG. 18 is a front view in perspective of the third embodiment of the invention, showing an additional security ring which contributes to make the container "child-proof";

FIG. 19 is a front view in perspective, showing how the novel container is pressed in order to allow dispensing of a single pill;

FIGS. 20 to 22 are upper views of several cross-sections which the inner receptacle may adopt in accordance with the third embodiment of the invention, depending on different types and sizes of the small articles to be dispensed.

DETAILED DESCRIPTION OF THE INVENTION

Following is a detailed description of the invention with reference to the drawings and wherein the same numbers are used to indicate the same parts in different figures.

Figure 16:
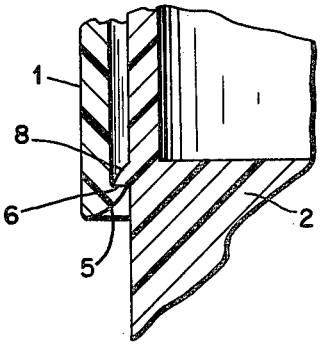

The container of the present invention for dispensing small articles one at a time, is constituted by three main components, which are:

An outer receptacle 1 which may be opened at one end; an inner receptacle 2 which may have the upper end permanently closed or may be closed by means of a removable top 3 and a resilient element 4 which is preferably located on the inner receptacle 2 and when enclosed by the outer receptacle 1, exerts a force against both receptacles tending to separate the same. In order to avoid the separation of both receptacles due to the pushing force of the resilient element 4, the outer receptacle 1 has near the lip of its open end a small continuous or sectioned lip ring 5 which is, preferably, an outerly sloped surface 6 and also another surface at a right angle with respect to the inner wall of the outer receptacle 1. Likewise, the inner receptacle 2 has immediately below the opening in its wall 7 a small peripheral rib 8, the profile of which is opposed to that of the shoulder 5 already mentioned for outer receptacle 1, in such a way that the outer receptacle 1 may be assembled over the inner receptacle 2, passing the rib 8, but cannot be taken out, because said surfaces 6 at right angles, (FIG. 16) are blocked one against the other, and therefore it is no longer possible to separate the receptacles.

The inner receptacle 2 has preferably in its lower end an inclined surface 9 facing the opening 7 in the wall of this receptacle, in order to expedite the dispensing of the small articles.

On the other hand, the outer receptacle has on its wall an opening 10 to allow the exit of the small articles. The size of this opening is slightly larger than the size of the corresponding opening 7 on the wall of the inner receptacle 2. This opening 10 may be covered by an integral section of the same material as the receptacle, this section having in its periphery a weakening line and a small tab 11 which allows the section to be detached when said tab is pulled. Also, there is on the outer receptacle one small fasteneing clip 12, in accordance with the first embodiment of the invention, as shown in FIGS. 1 to 6.

Figure 10:
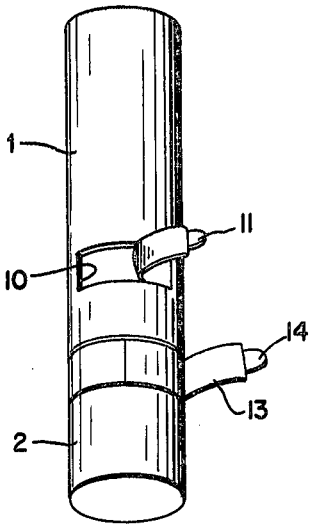
Figure 11:
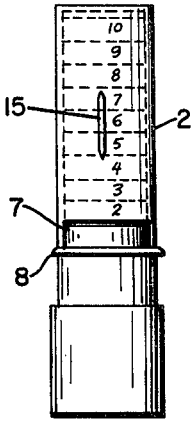
Figure 12:
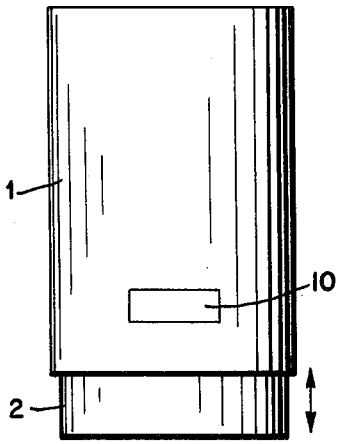
Figure 13:
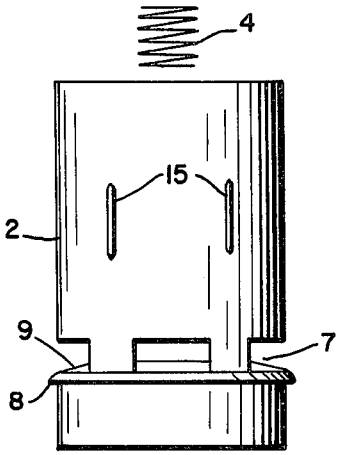

The outer receptacle 1 may have a lower ring 13, as shown in FIGS. 10 and 17 which is formed by the circular section of the same material as the receptacle 1, this section being located in the lower part of the receptacle and having a weakening line and a small tab 14 which allows this section to be detached when the tab is pulled.

Figure 14:
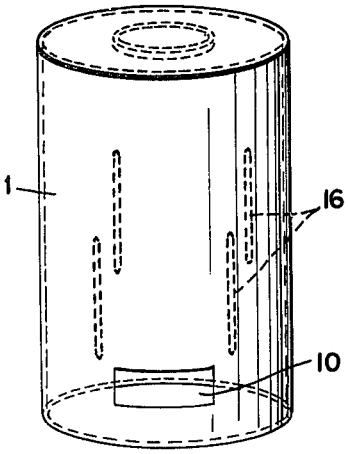
Figure 15:
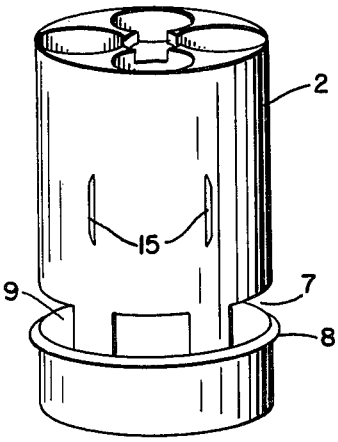

The inner receptacle 2 on its outer wall has one or more ribs 15 which are vertically placed, the number thereof depending on the different embodiments of the invention. These ribs correspond to grooves 16 located on the inner wall of the outer receptacle 1 (FIG. 14). By these means it is possible to control the rotation of the outer receptacle, as per the third embodiment of the invention, and also contribute to the alignment of the opening 7 of the inner receptacle 2 with the opening 10 of the outer receptacle 1.

Figure 9:
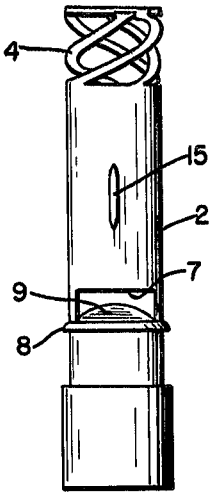

It is important to notice that the resilient element or spring 4 may be constructed of any metallic or plastic material and that the same may constitute an integral part of the inner receptacle 2 as shown in FIG. 9.

Figure 1:
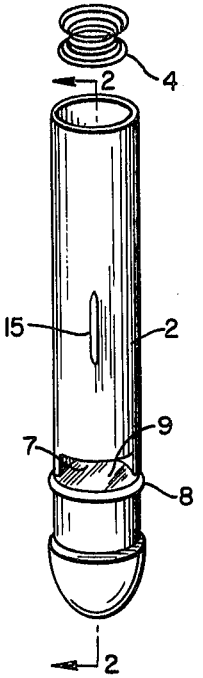
FIGS. 1 to 6 are related to the first of the embodiments of invention, which is called herein a "pen-type container".
Figure 2:
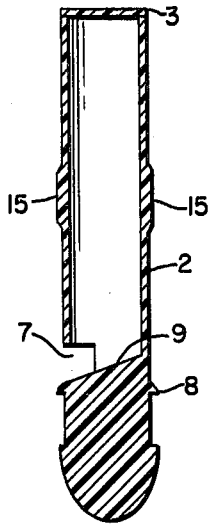
Figure 3:
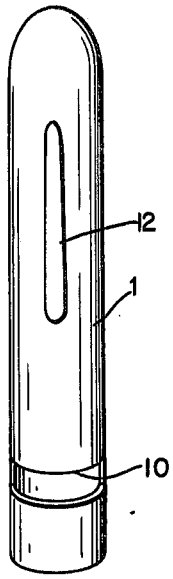
Figure 4:
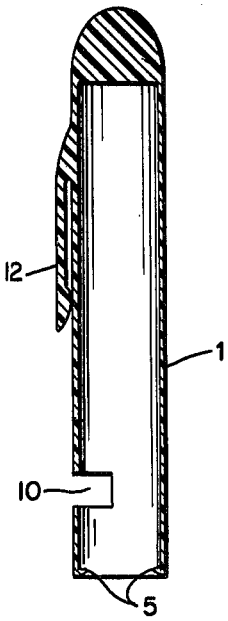
Figure 5:
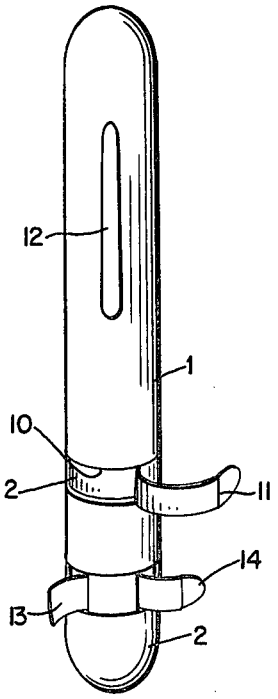
Figure 6:
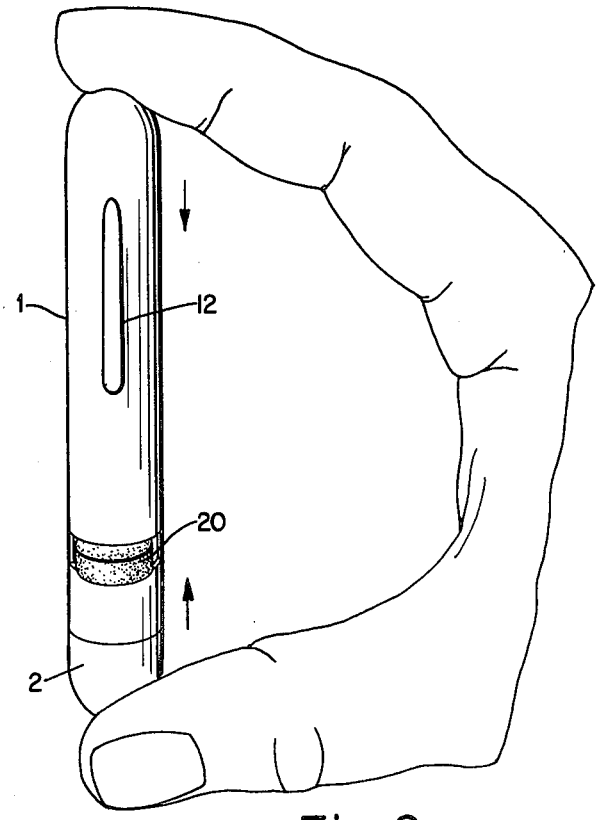
Figure 7:
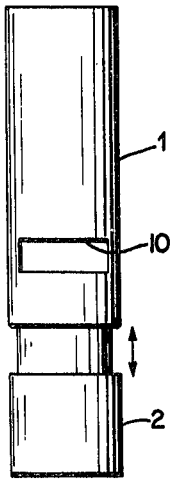
Figure 8:
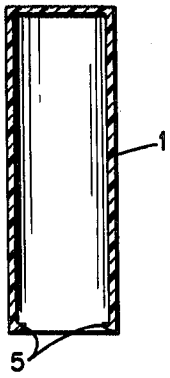

Making reference particularly to FIG. 18, a "childproof" safety ring is shown 17 located in the lower portion of the outer receptacle 1, in such a way, that the same may be rotated freely in either direction. It is also considered that a small mark such as an arrow 18 may be provided on the safety ring which should be placed in alignment with a corresponding mark shown as 18' on the external wall of the outer receptacle 1. By these means it is easier to align all three openings, opening 7 in the inner receptacle, opening 10 in the outer receptacle and opening 19 in the safety ring 17. FIGS. 6 and 19 show the simple way the container is operated which consists of pressing both receptacles until the openings are aligned allowing the small articles to be dispensed from the container one at a time.

In FIGS. 20 to 22 different alternatives of subreceptacles are shown. The cross-section of these subreceptacles of the inner receptacle 2 depend on the various types of small articles to be dispensed. It must be understood that these alternatives are not limitative but only for illustrative purposes. It must be also understood that different subreceptacles may be combined to allow various types of pills to be dispensed from a single container.

Finally, there is the embodiment, not shown in the drawings, that the inner receptacle may have within its base, a small cavity to contain any hygroscopic material, such as silica gel, activated carbon, etc., which my means of small holes could be in communication with the small article in order to eliminate the moisture if any, within the inner receptacle.

As it may be appreciated, the invention has been disclosed in several of its preferred embodiments and it may be easily understood by those cognizant with the art that same is susceptible to modification. These modifications will be considered within the scope of the invention, which is limited only by the claims which follow.

What is claimed is:

1. A tamperproof dispensing container for dispensing single articles comprising:
   (a) an inner receptacle containing the articles to be dispensed and having a base with a peripheral shoulder;
   (b) an outer receptacle enclosing said first receptacle;
   (c) a resilient element disposed between said inner receptacle and said outer receptacle so that said resilient element exerts a force tending to separate said receptacles;
   each of said receptacles having a lateral opening in its lower portion, said lateral openings coming into alignment and thereby permitting the dispensing of one of said articles upon said resilient element being depressed;
   said receptacles being provided with a means for preventing disassembly of the receptacles after the dispensing container has been assembled; and
   said outer receptacle having an integral detachable ring in its lower portion which is locked against the peripheral shoulder of the base of the inner receptacle, said ring preventing depression of said resilient element and thereby obstructing operation of said container.

2. The container of claim 1 wherein said opening in the outer receptacle is covered by an integral detachable section, said integral detachable section being of the same material as said receptacle, and having weakened lines and a tab that permit detaching said section.

3. The container of claim 1 wherein said detachable ring has peripheral weakened lines and a tab which permit detachment of said ring to permit operation of the container.

4. The container of claim 1 wherein the inner receptacle is divided into at least two sub-receptacles of the same cross-section.

5. The container of claim 4 wherein the subreceptacles of the inner receptacles each have inner inclined bottom surfaces facing an opening in the wall of the inner receptacle.

6. The container of claim 1 wherein the inner receptacle has at least one rib with rounded edge vertically located on the external wall thereof, and wherein the outer receptacle has corresponding grooves longer than said rib in which said rib runs when said resilient element is depressed, said rib and grooves acting to restrict rotation of the outer receptacle on the inner receptacle.

7. The container of claim 1 wherein there is provided a safety exterior ring located between two peripheral ribs on the outer receptacle, said ribs permitting said safety ring to rotate freely in any direction, and said safety ring having an opening slightly larger than said openings of the inner and outer receptacles.

8. The container of claim 7 wherein said safety ring and the external wall of said outer receptacle are each provided with a mark to permit easy alignment of said safety ring opening with said receptacle openings.

9. The container of claim 1 wherein the inner receptacle is divided into two or more subreceptacles, at least two of which differ in cross-section, thereby permitting dispensing of articles of different cross-section.

10. The container of claim 1 wherein said peripheral shoulder acts to limit the movement of the outer receptacle over the inner receptacle when said resilient element is depressed, said tamperproof detachable ring having been removed so as to permit resilient element depression.

11. The container of claim 1 wherein said means for preventing disassembly comprises a circular rib located below the opening of the inner receptacle and a lip ring located below the outer receptacle opening, said circular rib and said lip ring having inclined surfaces which allow the outer receptacle to slip over the inner receptacle to form the container but which block container disassembly by means of peripheral surfaces at right angles with respect to the receptacle walls.

12. The container of claim 1 wherein said inner receptacle has an inner bottom inclined surface facing the opening in the wall thereof, said inclined surface assisting the exit of the articles contained within said inner receptacle.

13. The container of claim 1 wherein said outer receptacle has an exterior fastening clip to assist in the fastening of the container on this surfaces.

14. The container of claim 1 wherein said articles to be dispensed are selected from the group consisting of pills, troches, tablets, lozenges, capsules and pearls.

15. A dispensing container for dispensing single articles comprising:

(a) an inner receptacle containing the articles to be dispensed and having a base with a peripheral shoulder;

(b) an outer receptacle enclosing said first receptacle;

(c) a resilient element disposed between said inner receptacle and said outer receptcale so that said resilient element exerts a force tending to separate said receptacles;

each of said receptacles having a lateral opening in its lower portion, said lateral openings coming into alignment and thereby permitting the dispensing of one of said articles upon said resilient element being depressed;

said receptacles being provided with a means for preventing disassembly of the receptacles after the dispensing container has been assembled; and said container being provided with a safety exterior ring located between two peripheral ribs on the outer receptacle, said ribs permitting said safety ring to rotate freely in any direction, and said safety ring having an opening slightly larger than said openings of the inner and outer receptacles.

16. The container of claim 15 wherein said safety ring and the external wall of said outer receptacle are each provided with a mark to permit easy alignment of said safety ring opening with said receptacle openings.

* * * * *